United States Patent [19]

Andaya

[11] 4,378,664

[45] Apr. 5, 1983

[54] SYSTEM FOR CONSTRUCTING A BUILDING

[75] Inventor: Antonio P. Andaya, Metro Manila, Philippines

[73] Assignee: Pilar Development Corporation, Manila, Philippines

[21] Appl. No.: 141,389

[22] Filed: Apr. 18, 1980

[30] Foreign Application Priority Data

Jun. 8, 1979 [PH] Philippines ..... 22867

[51] Int. Cl.[3] ..... E04C 3/00; E04G 21/00

[52] U.S. Cl. ..... 52/745; 52/744

[58] Field of Search ..... 52/745, 744, 122, 126, 52/127

[56] References Cited

U.S. PATENT DOCUMENTS 3,834,110 9/1974 Vercelletto ..... 52/745

3,952,471 4/1976 Mooney ..... 52/745 X 4,231,199 11/1980 Gomez et al. ..... 52/745

*Primary Examiner*—J. Karl Bell

*Attorney, Agent, or Firm*—Owen, Wickersham & Erickson

[57] ABSTRACT

An improved system for constructing a building out of pre-fabricated housing components such as columns, beams, panels, etc., by anchoring and interconnecting said components by means of nuts and bolts together with peripheral jointing along both lengths or height of the panel.

3 Claims, 33 Drawing Figures

13
14
12
16
2
15
7
17

5
8
1

18

SYSTEM FOR CONSTRUCTING A BUILDING

BACKGROUND OF THE INVENTION

This invention relates to a system for constructing a building and more particularly, to an improved system whereby the plurality of housing components such as panels, columns, beams, etc. are anchored, interconnected and jointed by means of nuts and bolts.

Increasing numbers of building designers and contractors as well as real estate developers are specifying and making extensive use of prefab/precast housing components such as walls, partitions, floors, columns, beams, etc. in the construction of houses, apartments and buildings. This is due to the definite advantages that can be derived with the use of prefab/precast housing components over conventional construction materials. Prefab/precast housing components come in various structural designs and dimensional forms, permitting a wide range of applications in meeting functional as well as technical and field requirements of building designers, contractors and developers heretofore difficult, if not impossible to attain, due to inherent limitations in the basic nature of the construction materials used.

Building designers as well as contractors and real estate developers, working together with housing component fabricators, have evolved various systems of constructing houses, apartments and buildings involving methods peculiar to the design and the materials used in fabricating housing components. In almost all cases, the systems used employed the welding of interlocking and/or interconnecting steel rods as well as steel plates or straps strategically situated as part and parcel of the housing components, to be followed by grouting and/or plastering.

In order to remedy the disadvantages of the prior art, I provide for a novel system of constructing a building using columns and beams with steel plates and bars that may be interlocked to adjoining columns and beams by welding, thereby to forming a framework whose peripheral walls and partitions are a plurality of panels containing nuts, bolts and dowels that may be secured to adjoining panels and firmly locked with them by strapping and bolting. The objectives of this invention are as follows:

1. To improve the overall system of constructing houses, apartments and buildings in terms of quality, cost and speed of erection and installation of prefab/-precast housing components;

2. To provide a system whereby prefab/precast housing components may be installed faster and with great ease to form the outer shell of houses, apartments and buildings under any field condition;

3. To provide the means to construct houses, apartments and buildings whereby prefab/precast housing components may be anchored and/or interconnected to any other housing components by the use of electric or gas welding and such equipment operations requiring a minimum of electrical power;

4. To provide the means by which prefab/precast housing components may be anchored and/or interconnected to any other housing components without the use of pouring form-works or roofing tie-beams;

5. To provide the means to construct houses, apartments and buildings whereby the erection and installation of prefab/precast housing components could be carried out in a manner that would lend itself to the adoption of production line techniques, characterized by simple and routine but specialized field activities involving the minimum application of skilled labor.

Other objects, advantages and features of the invention will become apparent from the following detailed description thereof presented in conjunction with the accompanying drawing:

DETAILED DESCRIPTION OF EMBODIMENT

Figures 1, 2:
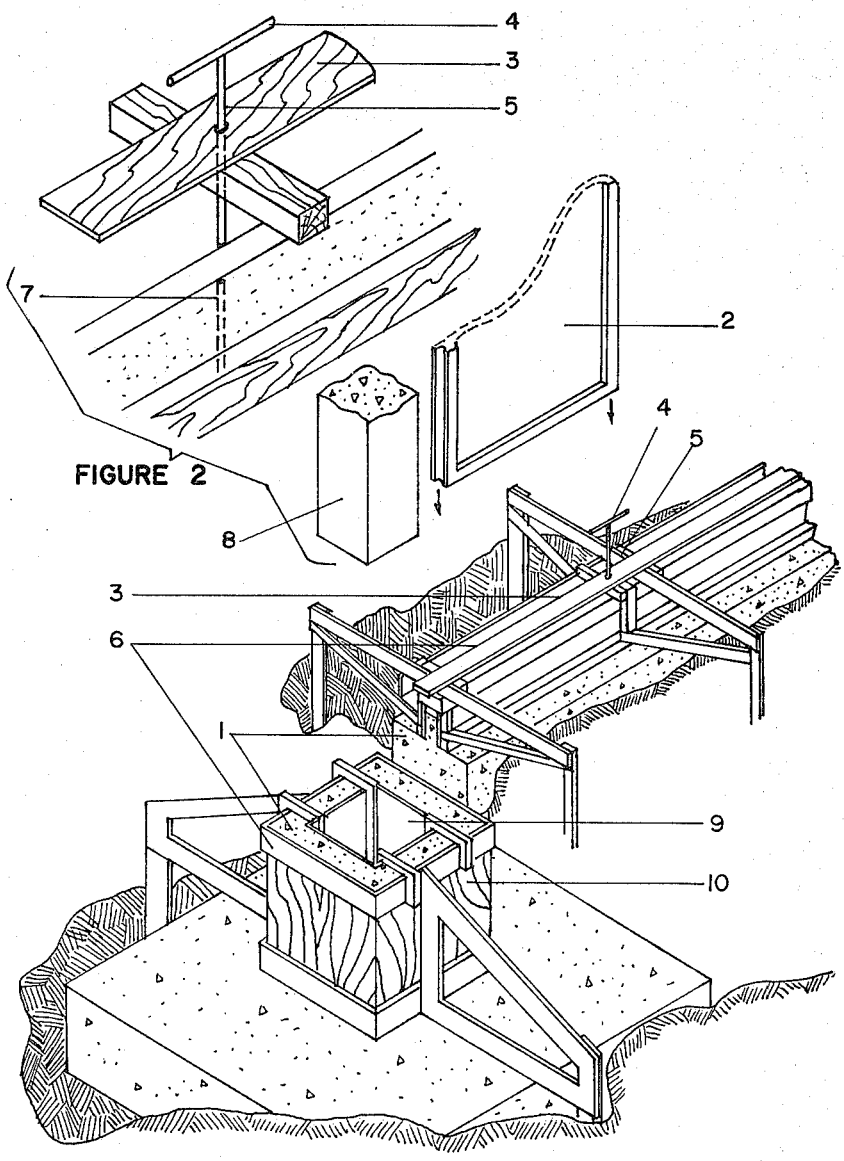
FIG. 1 is a view in perspective of a portion of a building foundation as prepared and developed in the field by the improved system of the present invention.
FIG. 2 is an enlarged exploded view of a top section for the foundation shown in FIG. 1.
Figures 3, 4, 5, 6, 7, 8:
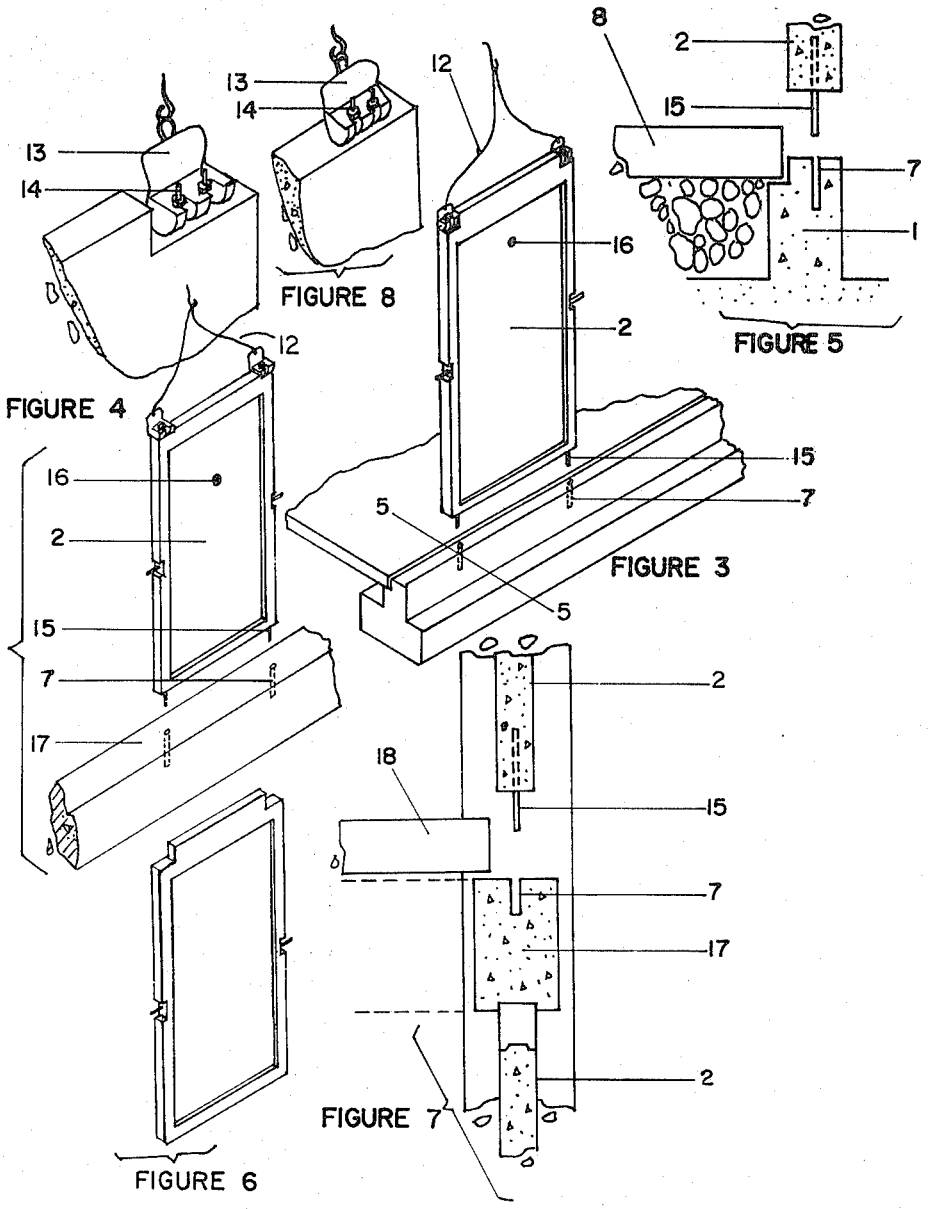
FIG. 3 is a view in perspective of a prefab/precast panel being positioned for erection according to the invention.
FIG. 4 is an enlarged partial view of the upper-end corner of a lower floor wall panel.
FIG. 5 is a partial view in section of the foundation and panel of FIG. 3 taken along the line 5—5.
FIG. 6 is a perspective view of a portion of lower and upper floor wall panels being assembled together according to the invention with a beam that supports the slabs and upper floor wall panels.
FIG. 7 is a partial sectional view of the beam and panels of FIG. 6.
FIG. 8 is an enlarged partial view of the upper-end corner of the upper floor wall panels.

Referring now to the different perspective and elevation views of the drawings, there is shown in FIG. 1 a concrete foundation 1 formed by pouring concrete into casting and/or pouring forms 6 on top of which is placed a template 3 provided with removable dowels 4 to fit preformed holes 5 on the template 3, as shown in detail in FIG. 2, so that anchoring holes 7 are formed on the foundation 1 to which prefab/precast panels may be anchored. A prefab/precast column 8, that will fit into a pedestal socket 10 whose opening 9 is poured in accordance with the column dimensions, is plugged and fitted. FIG. 3 shows a prefab/precast panel 2 that is provided with a clamping hole 16 on its top-face, and a plurality of bolts and nuts 14 at each of the top-end corners to which a steel cup-claw 21 is fitted, as shown in detail in FIG. 4, for hoisting by means of a steel cable 12 that may be connected with any form of materials handling and hoisting equipment so that the panel 2 may be properly positioned for erection and installation.

FIG. 5 shows the bottom-end corner of the prefab/-precast panel 2 which is provided with steel bar dowels 15 which fit into the anchoring holes 7 on top of the foundation 1 that support the concrete floor slab 8*a*.

FIG. 6 shows a prefab/precast panel 2 to be used in the upper floors of the building, that is provided with a clamping hole 16 on its top-face and a plurality of bolts and nuts 14 at each of the top end corners to which steel cup-claw 13 is fitted, as shown in detail in FIG. 4, for hoisting by means of a steel cable 12 that may be connected with any form of materials handling and hoisting equipment so that the panel 2 may be properly positioned for erection and installation on the top of the beam.

FIG. 7 shows at the bottom end corner of the prefab/precast panel 2 being provided with steel bar dowels 15 that will fit into the anchoring holes 7 on the top of the beam 17 that supports the upper floor slab 18.

Figure 12:
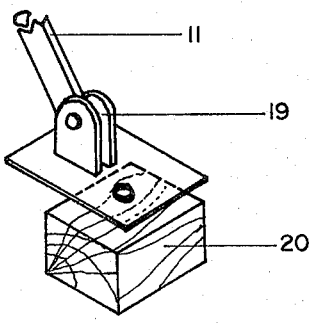
FIG. 12 is a view in perspective of the base of the steel brace shown in FIG. 9.
Figure 9:
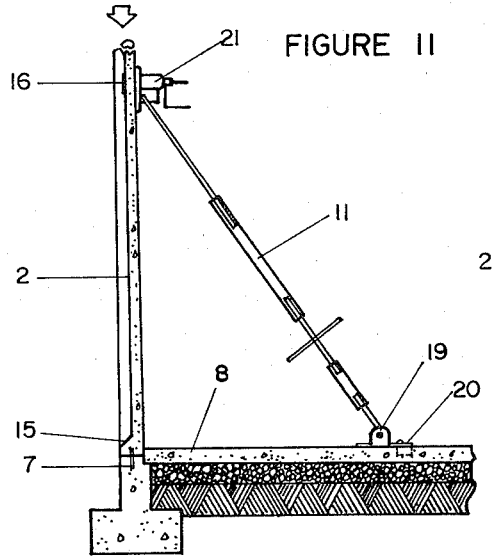
FIG. 9 is a sectional view in side elevation of an individual prefab/precast lower floor wall panel braced to stand alone as a single unit not yet jointed with other housing components.
Figure 10:
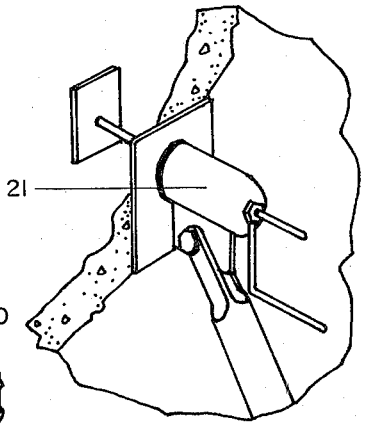
FIG. 10 is a view in perspective of a clamping device for the steel brace shown in FIG. 9.

FIG. 9 shows how a panel is erected. Once the steel bar dowel 15 at each of the bottom-end corners of the panel 2 is fitted into the anchoring holes 7 in the foundation beam 1, a clamping-head 21 at the top-end of the steel brace 11, as shown in FIG. 10, is allowed to clamp the panel 2 at the clamping hole 16. The base 19 of the steel brace 11 is then fastened to a wooden peg 20 embedded in the floor slab 8*a* by means of a lug screw as shown in detail in FIG. 12. The plumb of the panel is adjusted by manipulating the tensioning screw of the steel brace 11.

Figure 11:
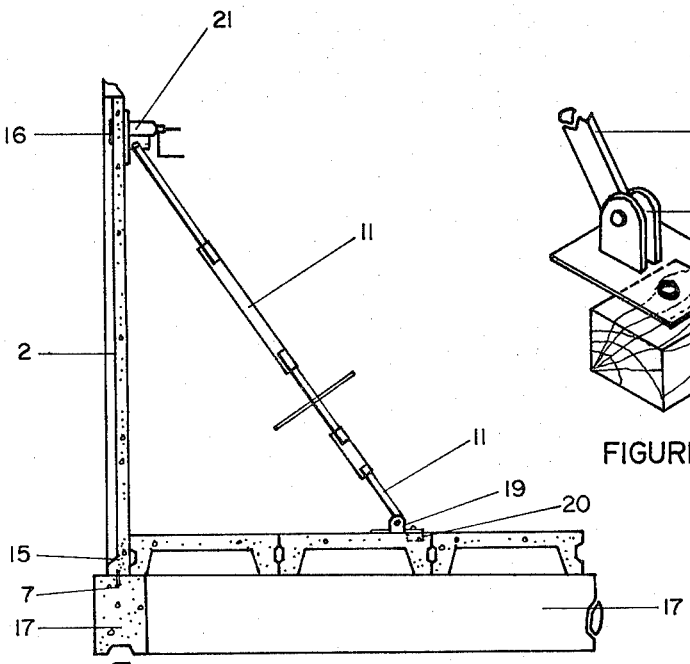
FIG. 11 is a sectional view in side elevation of an individual prefab/precast upper floor wall panel braced to stand alone as a single unit not yet jointed with other housing components.

FIG. 11 shows how a panel in the upper floors is erected. Steel bar dowels 15 at each of the bottom-end corners of the panel 2 are fitted into the anchoring holes 7 in the upper floor beams 17, and the clamping head 21 of the top-end of the steel brace 11, as shown in detail in FIG. 10, is allowed to clamp the panel 2 at the clamping hole 16. The base 19 of the steel brace 11 is then fastened to the wooden peg 20 embedded in the upper floor slabs 18 by means of a lug screw as shown in detail in FIG. 12. The plumb of the panel is adjusted by manipulating the tensioning screw of the steel brace 11.

Figure 14:
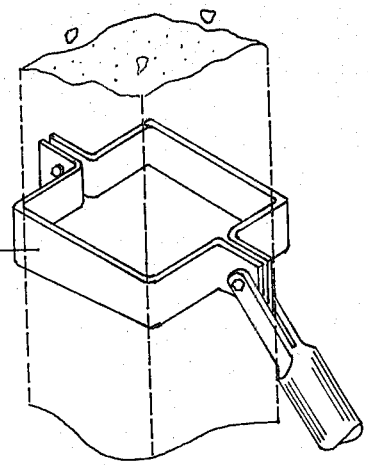
FIG. 14 is a view in perspective of the clamping device for the steel brace shown in FIG. 13, for a column.
Figure 13:
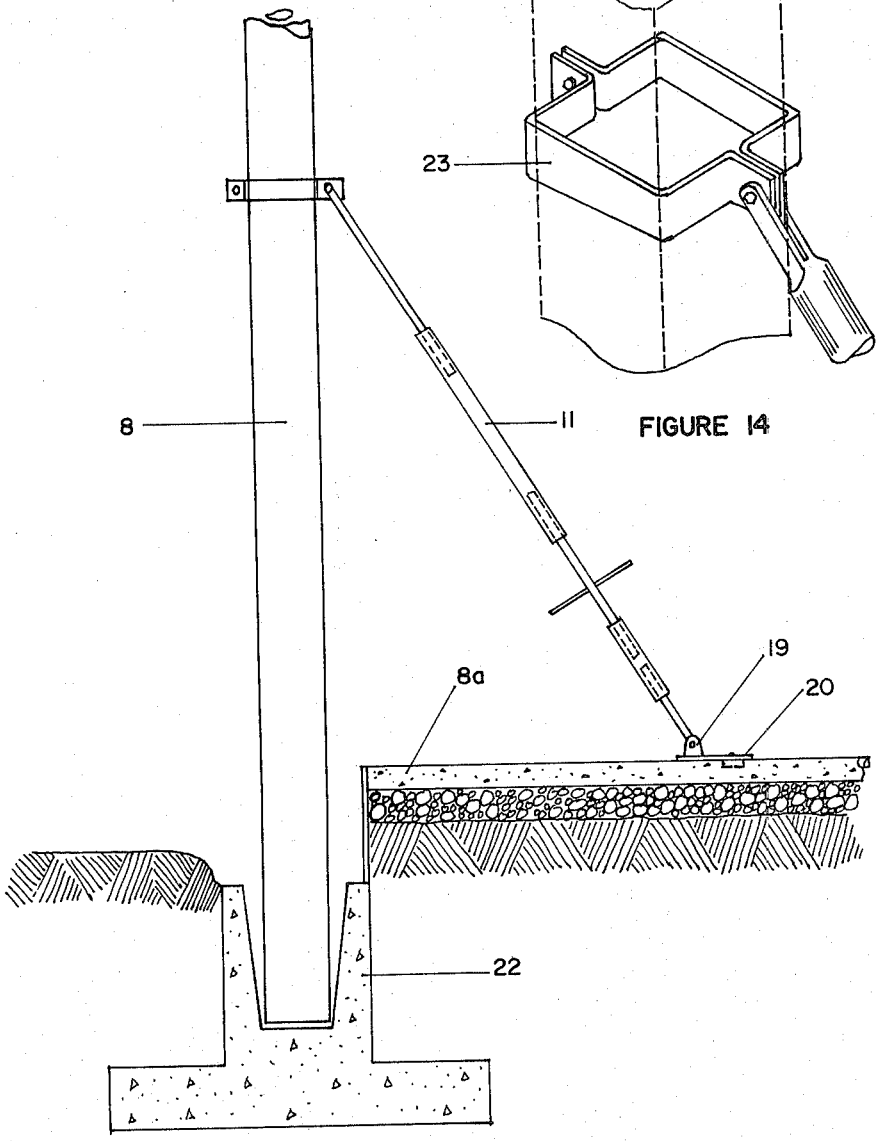
FIG. 13 is a sectional view in side elevation of an individual prefab/precast column braced to stand alone as a single unit not yet jointed with another column by using beams.

FIG. 13 shows how a column 8 is erected. Once the column 8 is a socket type pedestal 22, the clamping strap 23 at the top-end of a steel brace 11, as shown in FIG. 14, is allowed to clamp the column 8 at the specified height where the panel 2 could not reach, and the base 10 of the steel brace 11 is then fastened to the wooden peg or block 20 embedded in the floor slab 8*a* by means of lug screw as shown in detail in FIG. 12. The plumb of the column is adjusted by manipulating the tension screw of the steel brace 11.

Figure 15:
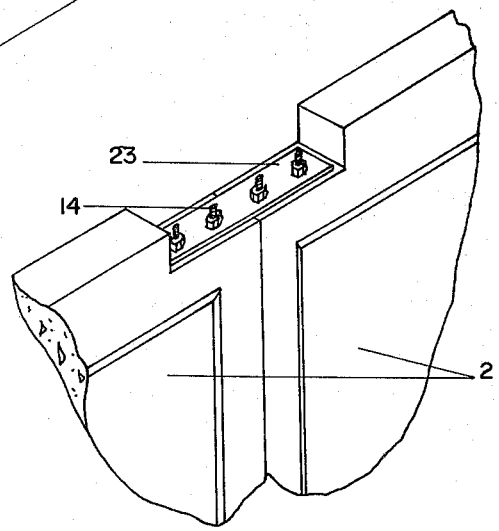
FIG. 15 is a partial perspective view of a typical interconnection between two prefab/precast panels at the lower floor.
Figure 16:
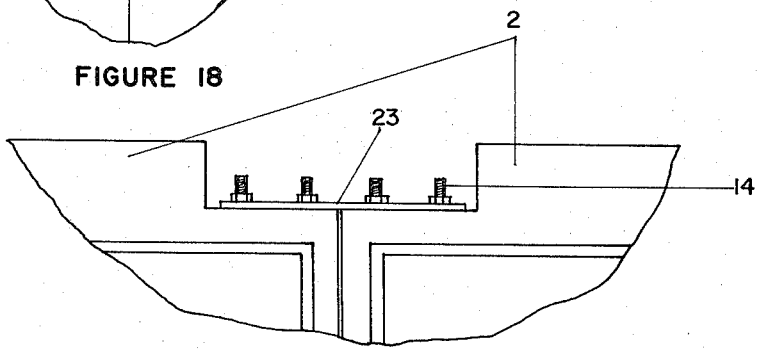
FIG. 16 is a side view in elevation of the interconnection of the joint formed by two prefab/precast lower floor wall panels installed side-by-side, as shown in FIG. 15.

FIGS. 15 and 16 shows how two lower floor panels 2 are interconnected with another panel by fitting a flat straight bar strap 23 into the bolts and nuts 14 at the matching top-ends of the adjoining panels.

Figure 17:
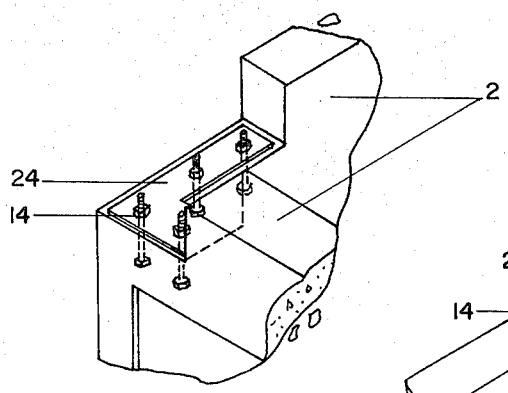
FIG. 17 is a partial perspective view of another interconnection between two corner lower floor wall panels showing an "L"-shaped flat bar strap secured to said panels by means of bolts and nuts.

FIG. 17 shows how two lower floor panels 2 are interconnected, when they meet at a 90 degree corner, by fitting a flat "elbow" or "L" shaped bar 24 with the bolts and nuts 14 at the matching top-ends of the adjoining panels.

Figure 18:
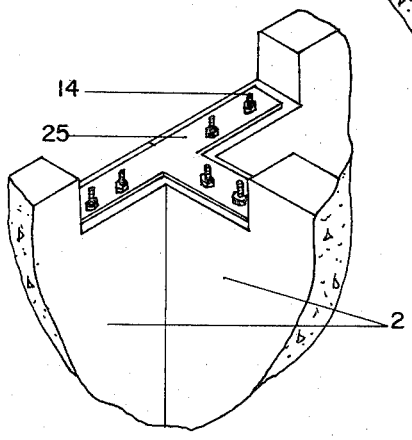
FIG. 18 is a partial perspective view of another interconnection between three partitions of lower floor wall panels showing a "T"-shaped flat bar strap secured to said panels by means of bolts and nuts.

FIG. 18 shows how three panels 2 are interconnected with one another, when one panel intersects the other two panels at 90 degrees, at the common or matching ends by fitting a flat "T"-shaped bar strap 25 into the bolts and nuts 14 at the matching top-ends of the adjoining panels.

Firm interconnection of the joint is accomplished by wrenching the nuts of the bolts 14 against the flat bar strap for maximum tightening.

Figure 19:
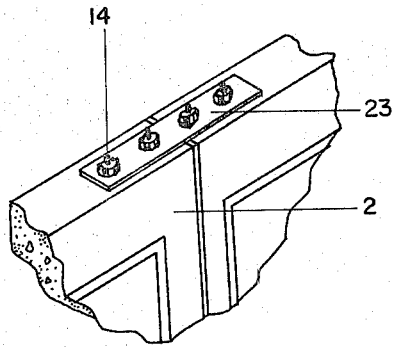
FIG. 19 is a partial perspective view of a typical interconnection between two prefab/precast panels at the upper floor.
Figure 20:
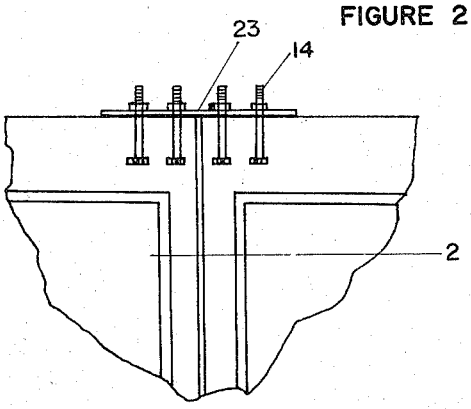
FIG. 20 is a view in side elevation showing the interconnection of the joint formed by two prefab/precast at the upper floor wall panels installed side-by-side, as shown in FIG. 19.

FIGS. 19 and 20 shows how upper floor panels 2 are interconnected with other panels by fitting a flat, straight bar strap 23 into the bolts and nuts 14 at matching top-ends of the adjoining panels.

Figure 21:
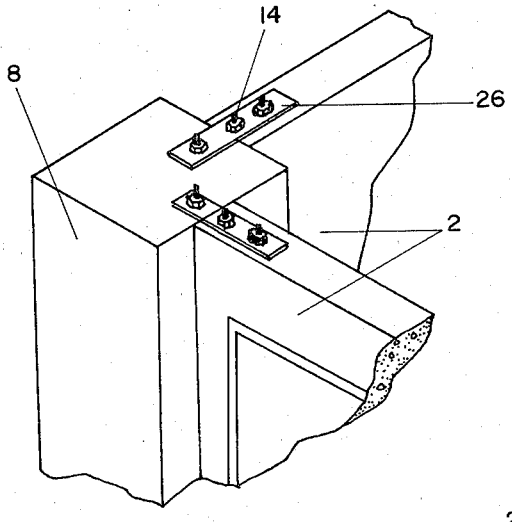
FIG. 21 is a partial perspective view of another interconnection between two corner upper floor wall panels showing flat bar straps secured to the corner column by means of bolts and nuts.
Figure 22:
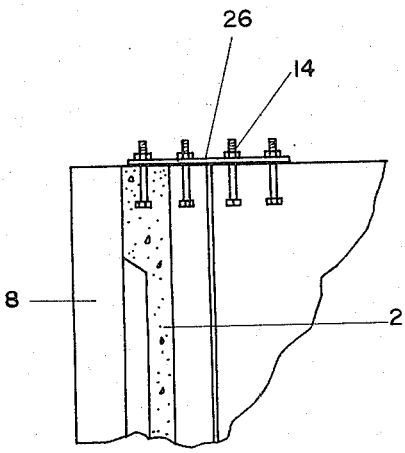
FIG. 22 is a view in side elevation of the interconnection of a joint formed by two prefab/precast at the upper floor wall panels installed at an angle of 90 degrees, as shown in FIG. 21.

FIGS. 21 and 22 show how two upper floor panels 2 are interconnected, when they meet at a column 8 at a 90 degree corner, by fitting a flat bar strap 26 with bolts and nuts 14 at matching top-ends of the adjoining panels.

Figure 23:
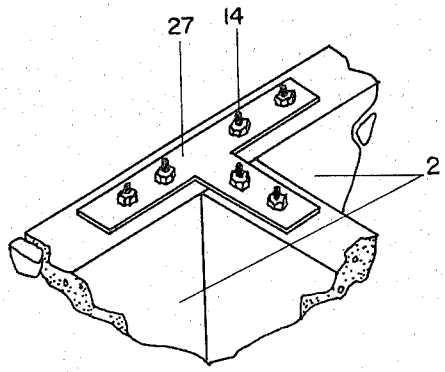
FIG. 23 is a partial perspective view of another interconnection between three partition upper floor wall panels showing a "T"-shaped flat bar strap secured to said panels.

FIG. 23 shows how three upper floor panels 2 are interconnected with one another when one panel intersects the other two panels at 90 degrees, at the common or matching ends by fitting a flat "T"-shaped bar strap 27 into the bolts and nuts 14 at the matching top-ends of the adjoining panels.

Figure 25:
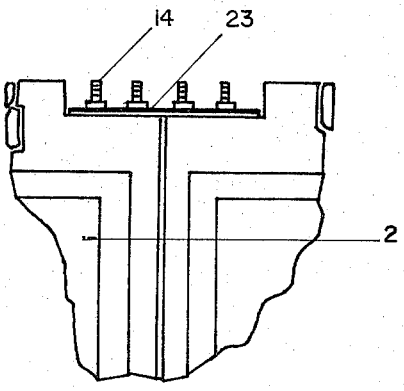
FIG. 25 is a view in side elevation of the interconnection of the joint formed, as shown in FIG 24.
Figure 24:
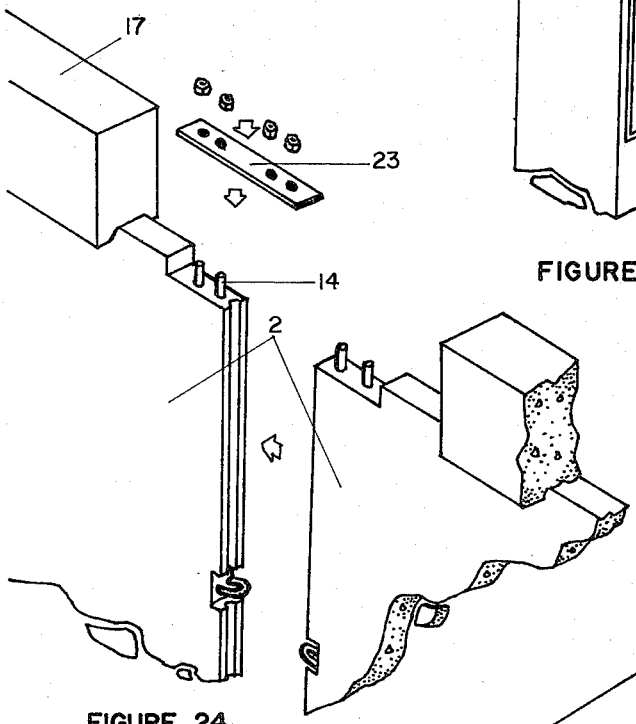
FIG. 24 is a partial perspective view of the interconnection between lower floor wall panels showing flat bar straps secured to said panels and interlocked by beams.

FIGS. 24 and 25 shows how two panels 2 are interconnected with another panel by fitting a flat straight bar strap 23 into the bolts and nuts 14 at matching top-ends of the adjoining panels, and a beam 17 is interlocked on the upper end of the panels 2.

Figure 26:
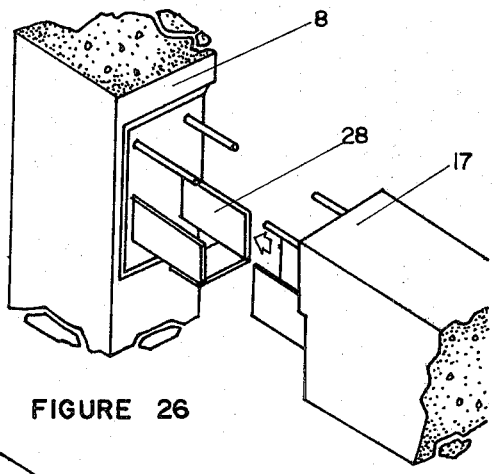
FIG. 26 is a partial perspective view of another interconnection between prefab/precast column and beam showing vertical flat bar plates and dowels which are secured to said column and beams by means of welding.

FIG. 26 shows how the beam 17 is anchored and interlocked to the column 5 by welding vertical flat shear plates and dowel bars 28 of the beam to the previously installed shear plates and dowel bars of the column. After full welding, the gap created will then be poured with concrete same strength of the columns and beams.

Figure 27:
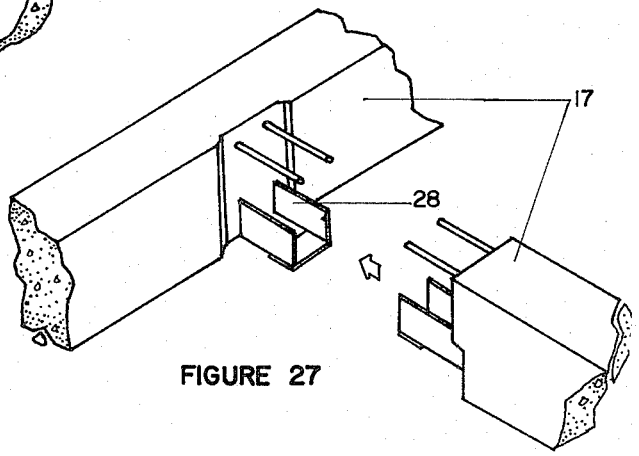
FIG. 27 is a partial perspective view of another interconnection between prefab/precast beams showing vertical flat bar plates.

FIG. 27 shows how the beam 17 is anchored to another beam 17 by means of welding the vertical flat shear plates and dowel bars 28 of the beams 17.

Figure 28:
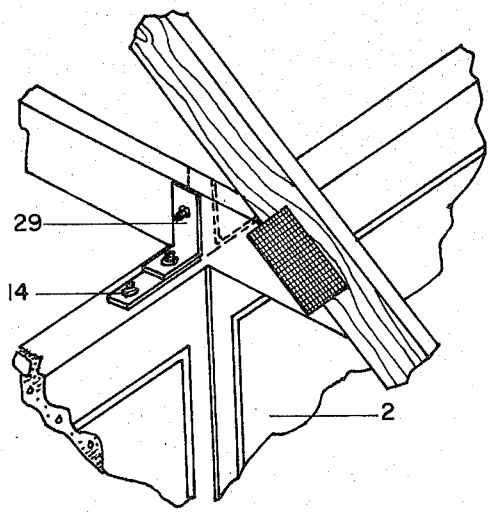
FIG. 28 is a perspective view of a typical building installation showing anchored and interconnected panels relative to other housing components.
Figure 29:
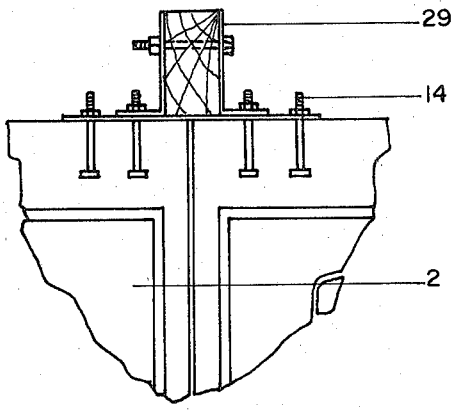
FIGS. 29 and 30 are side and top elevation views, respectively, showing the anchorage of a truss to the prefab/precast panels interconnected as in FIG. 28.
Figure 31:
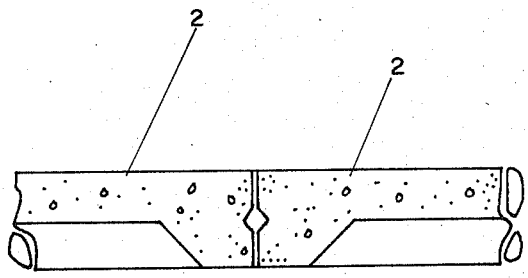
FIG. 31 is a view in section of a vertical joint of the interconnected panels shown in FIG. 28.
Figure 30:
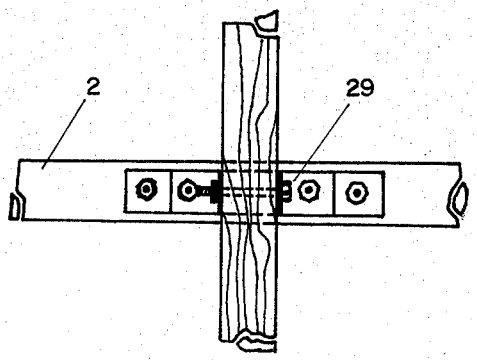

FIG. 28 shows how a truss is anchored to the panels 2 by installing two flat angular bars 29 over the previously installed flat bar strap 23. The angular bars 29 are fitted into the last matching bolts 14 of the interconnected panels 2, and again, the nuts are wrenched for maximum tightening. The truss is then fitted between the angular bars 29 and they are bolted together. Side and top views of the truss anchorage are shown in detail in FIGS. 29 and 30, respectively. Peripheral profiles of the prefab/precast panels 2 are such that, when joined together, they form voids as shown in FIG. 31, in which concrete is poured to form an effective bond between adjoining panels 2.

Figure 32:
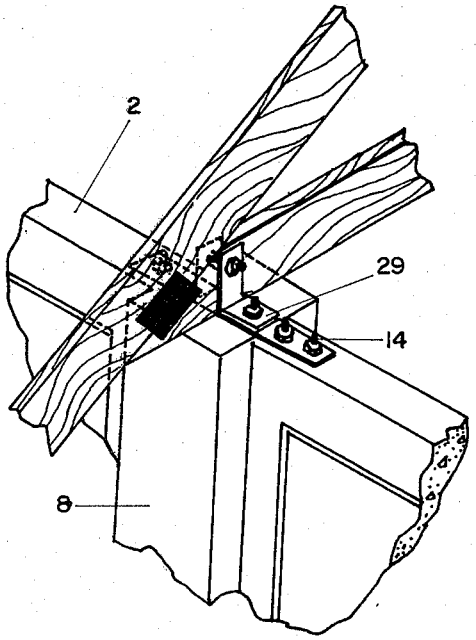
FIG. 32 is a perspective view of a typical building installation showing anchored and interconnected panels relative to a column.
Figure 33:
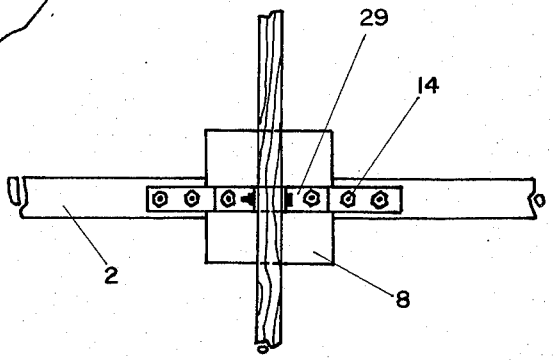
FIG. 33 is a top view of the anchorage of the truss to the prefab/precast panels/column interconnected as shown in FIG. 32.

FIG. 32 shows how the truss is anchored to the column 8 by installing two flat angular bars 29 over the previously installed flat bar strap 26. The angular bars 29 are fitted into the last matching bolts 18 of the interconnected panels 2, and again, the nuts are wrenched for maximum tightening. The truss is then fitted between the angular bars 29 and they are bolted together. A top elevational view of the truss anchorage is shown in detail in FIG. 33.

The novel system for constructing a building would therefore be done in the following manner:

1. Preparation of the foundation 1 for the prefab/precast panels 2 involving the use of template 3 with a plurality of preformed holes 5 fitted with removable dowels 4 and placing such templates 3 on top of the casting and/or pouring forms 6 so that the predetermined anchoring holes 7 are formed on top of the foundation 1 following the setting and preparation of the socket type pedestal 10 with the opening 9 to fit the column 8 following the setting.

2. Preparation of the floor slab 8 with a plurality of wooden pegs or blocks embedded in the slab during the pouring of concrete, adapted to secure a plurality of braces 11.

3. Lifting or hoisting of the prefab/precast columns 8 by any type of materials handling and hoisting equipment provided with a lifting fixture consisting of a steel cable 12 at the ends of which are fitted steel hooks which, in turn, are made to slip into the lifting eye protruding on the side of the column.

4. Lifting or hoisting of the prefab/precast panels 2 by any type of materials handling and hoisting equipment provided with a lifting fixture consisting of a steel cable 12, the ends of which are fitted with steel cup-claws 13 which, in turn, are made to slip and lock into the bolts and nuts 14 protruding at the top-end corners of the prefab/precast panels 2.

5. Erection and installation of the first and such other prefab/precast panel 2 by hoisting and bringing said panel into position on top of the foundation 1 and gradually lowering said panel 2 so that the steel bar dowels 15 protruding at the bottom-end corners of the same panel fit snugly into the anchoring holes 7 of the foundation 1; and, at the same time, clamping the said panel through the clamping hole 16 with a steel brace 11 that is secured to the wooden peg 20 embedded in the floor slab 8a after which, the lifting fixture is freed by removing the steel cup-claws 13 from the bolts and nuts 14 and the steel brace 11 is so manipulated so as to insure the plumb of the prefab/precast panel 2.

6. Erection and installation of the succeeding prefab/precast panels 2 in like manner as the first except that, instead of connecting the steel brace 11, the subsequent panel 2 is interconnected with the previously installed panel 2 by securing a flat bar strap 23 into the two bolts and nuts 14 at the matching ends of the adjoining panels 2 and, in the same manner, another flat strap 23, will be secured to the other top-end corner of the panel 2 for interconnection with still another succeeding panel to be erected and installed.

7. Installation of still other prefab/precast panels 2 in the same fashion as the first and interconnected with previously installed panels in the same manner as any subsequent panel are installed except the other kind of flat bar straps 23 such as an "elbow" strap 24 is used for interconnection of two panels meeting at an 90 degree corner; and such other flat bar straps as the "T"-strap 25 that is used to interconnect one panel intersecting two other panels at 90 degrees.

8. Installation of the precast beam 17 on top of the panel 2 subsequently welded to the shear plates and dowel bars 28 of the column 8, thereby interlocking to the panels 2 previously installed.

9. Installation of precast slab at the upper floors 18 by lifting and laid above the top of the beam 17.

10. Installation of precast/prefab panels 2 at the upper floors in the same manner and fashion as the lower floors panels are installed except that dowel holes 7 is on top of the precast/prefab beam 17.

11. Installation of the prefab roof trusses by hoisting and bringing said trusses into position to fit between steel angular bars 29 bolted to the flat bars strap 23 which is used to interconnect adjoining prefab/precast panels 2 and the subsequent bolting of the steel angulars 29 to the prefab trusses, and 12. Pouring and/or injection of bonding mortar into the voids formed along the peripheral profiles of adjoining panels 2.

Having fully disclosed my invention of what I claim and desire to be protected by Letters Patent is:

1. An improved system for constructing a building with prefabricated panels, comprising the steps of:

preparing a level-topped foundation for the prefabricated wall panels utilizing templates having a plurality of preformed holes at preselected locations, fitted with removable vertically extending dowels, with the templates placed on top of foundation pouring forms so that anchoring holes are formed at predetermined locations in the top of the foundation following setting and curing of concrete poured into the forms;

preparing forms for socket type pedestals each with an opening to fit a prefabricated, precast column to be located at a end of a wall section;

preparing a floor slab by embedding a plurality of wooden blocks or pegs during the pouring of the concrete for the floor slab, whereby a plurality of angled wall panel stabilizing braces can be secured to the wooden blocks during erection of the building;

hoisting the prefabricated, precast columns with hoisting equipment provided with means for connection to the column, and lowering the columns into place in the socket type pedestals;

providing a plurality of prefabricated wall panels, all suitable as load-bearing wall panels and all being similar in outer dimensions, each panel also including protruding bolts and nuts at the top end corners of the panel and each including downwardly protruding steel bar dowels at its bottom, spaced for registry with and for close fit with the preformed anchoring holes in the foundation;

hoisting the prefabricated panels, one by one, with hoisting equipment including a steel cable stretching between the ends of a panel, and including steel cup-claws attached to the ends of the steel cable and slipped and locked onto the bolts and nuts protruding at the top end corners of the panel;

installing the first prefabricated wall panel in place on the foundation by positioning it over the foundation and lowering the panel so that the steel bar dowels at the bottom of the panel fit into the anchoring holes of the foundation;

temporarily retaining the installed wall panel in place using said angled brace, secured to one of the wooden blocks embedded in the floor slab, including connecting the other end of the brace to the installed wall panel and manipulating the brace to assure the plumb of the panel, and removing the cup-claws from the bolts and nuts at the top ends of the panel;

erecting succeeding prefabricated wall panels in like manner as the first panel, but instead of using a brace, interconnecting the subsequent panel with the previously installed panel by securing a flat bar strap onto the bolts and nuts at the adjacent top ends of the adjoining panels, and continuing this procedure for succeeding panels along the same wall;

at corners, installing adjacent prefabricated wall panels in the same manner as subsequent panels, but utilizing an L-shaped flat bar strap;

at T-shaped wall intersections, installing adjacent prefabricated panels in the same manner as subsequent panels, but utilizing a T-shaped flat bar strap for connection to the protruding bolts and nuts at the top ends of three adjacent panels in the T-shaped intersection;

installing prefabricated roof trusses by positioning each truss to fit, at each end, between angled brackets bolted to a flat bar strap connecting adjacent wall panels, with flanges of the brackets extending upwardly, and bolting the truss to the flanges of the brackets while the truss rests on the flat bar strap and on the tops of the wall panels, which serve as a roof beam, with no separate roof beam required; and placing bonding mortar into voids formed along the joints of adjoining panels.

2. An improved system for constructing a multiple-story building using prefabricated panels, comprising the steps of:

preparing a level-topped foundation for the prefabricated wall panels, utilizing templates having a plurality of preformed holes at preselected locations, fitted with removable vertically extending dowels, with the templates placed on top of foundation pouring forms so that anchoring holes are formed at predetermined locations in the top of the foundation following setting and curing of concrete poured into the forms;

preparing forms for socket type pedestals each with an opening to fit a prefabricated, precast column to be located at an end of a wall section;

preparing a floor slab by embedding a plurality of wooden blocks or pegs during the pouring of the concrete for the floor slab, whereby a plurality of angled wall panel stabilizing braces can be secured to the wooden blocks during erection of the building;

hoisting the prefabricated, precast columns with hoisting equipment provided with means for connection to the column, and lowering the columns into place in the socket type pedestals;

providing a plurality of prefabricated wall panels, all suitable as load-bearing wall panels and all being similar in outer dimensions, each panel also including protruding bolts and nuts at the top end corners of the panel and each including downwardly protruding steel bar dowels at its bottom, spaced for registry with and for close fit with the preformed anchoring holes in the foundation;

hoisting the prefabricated panels, one by one, with hoisting equipment including a steel cable stretching between the ends of a panel, and including steel cup-claws attached to the ends of the steel cable and slipped and locked onto the bolts and nuts protruding at the top end corners of the panel;

installing the first prefabricated wall panel in place on the foundation by positioning it over the foundation and lowering the panel so that the steel bar dowels at the bottom of the panel fit into the anchoring holes of the foundation;

temporarily retaining the installed wall panel in place using said angled brace, secured to one of the wooden blocks embedded in the floor slab, including connecting the other end of the brace to the installed wall panel and manipulating the brace to assure the plumb of the panel, and removing the cup-claws from the bolts and nuts at the top ends of the panel;

erecting succeeding prefabricated wall panels in like manner as the first panel, but instead of using a brace, interconnecting the subsequent panel with the previously installed panel by securing a flat bar strap onto the bolts and nuts at the adjacent top ends of the adjoining panels, and continuing this procedure for succeeding panels along the same wall;

at corners, installing adjacent prefabricated wall panels in the same manner as subsequent panels, but utilizing an L-shaped flat bar strap;

at T-shaped wall intersections, installing adjacent prefabricated panels in the same manner as subsequent panels, but utilizing a T-shaped flat bar strap for connection to the protruding bolts and nuts at the top ends of three adjacent panels in the T-shaped intersection;

following the erection of prefabricated wall panels on the foundation, installing precast beams having preformed holes at preselected locations in their upper surfaces, along the top of the panels, securing them to the columns and interlocking them with the plurality of wall panels previously installed;

installing precast floor slabs at the upper floor, resting on top of the installed beams;

installing prefabricated, precast wall panels at the upper floor in the same manner as the lower floor wall panels, but positioning the steel bar dowels at the bottoms of the panels in the preformed holes in the upper sides of the beams;

installing prefabricated roof trusses across the tops of the upper floor prefabricated wall panels by positioning each truss to fit, at each end, between angled brackets bolted to a flat bar strap connecting adjacent wall panels, with flanges of the brackets extending upwardly, and bolting the truss to the flanges of the brackets while the truss rests on the flat bar strap and on the tops of the wall panels, which serve as a roof beam, with no separate roof beam required; and placing bonding mortar into voids formed along the joints of adjoining panels.

3. The system for constructing a building according to claim 1 or 2 wherein at least some of the prefabricated wall panels include an opening, and wherein the wall panel stabilizing braces include a clamping head with means for extending through the opening in the panel and gripping the panel.

* * * * *